US011730681B2

(12) United States Patent
Smith

(10) Patent No.: US 11,730,681 B2
(45) Date of Patent: Aug. 22, 2023

(54) ORAL ENGAGEMENT INSTRUMENTS, RETAINER SYSTEMS, AND USES THEREOF

(71) Applicant: Christina Cognata Smith, Scottsdale, AZ (US)

(72) Inventor: Christina Cognata Smith, Scottsdale, AZ (US)

( * ) Notice: Subject to any disclaimer, the term of this patent is extended or adjusted under 35 U.S.C. 154(b) by 0 days.

(21) Appl. No.: 17/019,144

(22) Filed: Sep. 11, 2020

(65) Prior Publication Data

US 2020/0405583 A1 Dec. 31, 2020

Related U.S. Application Data

(63) Continuation-in-part of application No. PCT/US2019/022151, filed on Mar. 13, 2019.

(60) Provisional application No. 62/642,014, filed on Mar. 13, 2018.

(51) Int. Cl.
*A61J 17/00* (2006.01)
*A61J 17/02* (2006.01)

(52) U.S. Cl.
CPC ..... *A61J 17/111* (2020.05); *A61J 17/00* (2013.01); *A61J 17/001* (2015.05); *A61J 17/02* (2013.01)

(58) Field of Classification Search
CPC ..... A61J 17/00; A61J 17/001; A61J 17/02; A61J 17/10; A61J 17/111; A61J 17/1111; A61J 17/1115
See application file for complete search history.

(56) References Cited

U.S. PATENT DOCUMENTS

| | | | | |
|---|---|---|---|---|
| 4,898,171 | A | 2/1990 | Moss | |
| 4,909,253 | A * | 3/1990 | Cook | A61J 17/001 606/234 |
| 5,391,184 | A | 2/1995 | Rosenthal | |
| 5,607,452 | A * | 3/1997 | Michaud | A61J 17/00 606/234 |
| 6,269,502 | B1 | 8/2001 | Extrom | |
| 6,564,403 | B1 | 5/2003 | Titus | |
| 2002/0124297 | A1 | 9/2002 | Caris et al. | |
| 2008/0215092 | A1 * | 9/2008 | Smith | A61J 17/001 606/236 |
| 2012/0078143 | A1 * | 3/2012 | Hernandez | A61H 21/00 606/236 |

OTHER PUBLICATIONS

International Search Report and Opinion for PCT/US2019/22151 dated Jun. 6, 2019.

* cited by examiner

*Primary Examiner* — Todd J Scherbel
(74) *Attorney, Agent, or Firm* — Len S. Smith; Transformative Legal, LLC

(57) ABSTRACT

Provided herein are novel instruments for oral engagement with mammals (e.g., toddlers, pets, or people with special needs), such as for relieving infant or toddler sucking stress (e.g., pacifiers, teething rings, and pet toys), which contain an adhesive material positioned in an interior area of the instrument and that allows the instrument to be securely attached to a support device comprising a counter-adhesive material with a strength that maintains the suspended position of the instrument (prevents falling), but also releases to the instrument upon application of a manual physical force (e.g., pull) of the user; as well as related systems and methods.

22 Claims, 6 Drawing Sheets

ORAL ENGAGEMENT INSTRUMENTS, RETAINER SYSTEMS, AND USES THEREOF

CROSS-REFERENCE TO RELATED APPLICATIONS

This application claims priority to U.S. Provisional Patent Application No. 62/642,014, filed Mar. 13, 2018, and to International Patent Application No. PCT/US2019/022151, filed Mar. 13, 2019, of which this application is a continuation-in-part, both of which are hereby incorporated by reference.

BACKGROUND OF THE INVENTION

This invention relates to systems for holding instruments such as baby pacifiers, teethers, and similar products intended for oral use by infants and toddlers or other individuals that can benefit from such products (including people with certain conditions and/or special needs). Pacifiers and other instruments for easing sucking instincts and other issues in babies/infants (children under 1 years of age) and toddlers (children from 1-3 years are widely used, often by very grateful parents. In addition to soothing young ones and helping children (and their parents) get much needed rest there are suggestions in the medical community that such instruments, like pacifiers, may reduce the incidence of SIDS, promote oral hygiene, and reduce juvenile ear pain and/or symptoms of colic.

Children often lose access to their pacifiers/instruments when the child is placed with a pacifier/instrument in a crib, playpen, or other controlled area. The occurrence of such an event leads to the child, and correspondingly the child's parent(s), losing sleep, often in a very emotional manner. The problem has been long recognized, leading to a variety of attempts to solve the issue.

U.S. Pat. No. 6,564,403, for example, describes a bumper system for the side of a crib comprising a snap on pacifier holder for holding a single pacifier on the bumper.

U.S. Pat. No. 6,269,502 describes a blanket system comprising a system for holding a single pacifier. The pacifier is bound in place by a hook-and-loop attachment system that is attached to the blanket, binding the pacifier by passing through a loop of the pacifier. The system, accordingly, is limited to working with pacifiers that have a ring component. The system does not appear to have become commercially successful.

U.S. Pat. No. 5,607,452 describes a crib-mounted pacifier holder system comprising a retentive clamping system composed of two "fingers" that bind to a ring member of a certain kind of pacifier. Whether because of the clamp design, which may pose a safety hazard for young ones; the limitation of the system to pacifiers with rings, which many brands lack; or the apparent inability of at least most embodiments of the system to bind several pacifiers simultaneously, these systems do not appear to have become commercially successful and, for example, today cannot be readily found on major shopping sites, such as Amazon.com.

Other devices in the art attempt to address specific characteristics of instruments intended for oral engagement by a user which allow such a device to remain in the mouth of the user (e.g., not accidentally removed by a young infant), such as for example U.S. Pat. No. 4,898,171 describing an infant pacifier with a handle which can be recessed into the nipple of the pacifier, thus allegedly reducing the risk of an infant accidentally knocking the pacifier out of its mouth through movement. The device of the '171 patent is described as having a handle which could be attached to a ribbon or extended cord. Devices such as those described in US Patent Application US2002/0124297 address the loss of, for example, such instruments as a teether or a toy through use of attaching such instruments to a toy belt worn by the user or attached to, for example, a high chair, car seat, or the like. However, such a device could not be, e.g., used in circumstances such as a night time period wherein a child is confined within a crib due to safety risks (e.g., accidental dangerous engagement of a child with the long straps of such a device).

None of these previously described systems have led to a satisfactory solution for addressing the issue of a teething easing, or otherwise orally soothing instrument loss by infants/toddlers in controlled areas and unsupervised circumstances. Accordingly, there is a need in the art for alternative approaches to this issue. The invention described herein provides such alternative solutions.

SUMMARY OF THE INVENTION

The invention provides novel instruments and systems for oral engagement with mammals (e.g., toddlers, pets, or people with special needs), for use by such mammals in, for example, the relief of and/or soothing of sucking stress.

The invention in one aspect provides an instrument containing one or more adhesive materials positioned such that the instrument can be securely attached to a support device comprising a counter-adhesive material with a strength that maintains the instrument in a suspended position but which also releases the instrument upon application of a manual user force, such as a pulling of the instrument. In specific aspects, the invention described herein is an instrument configured for repeated oral use by a mammalian user comprising (a) an oral engagement component, (b) one or more interior areas, and (c) one or more reusable non-toxic adhesive material components positioned in the one or more interior areas, wherein the adhesive material is configured to engage a counter-adhesive material. In aspects, the invention is an instrument specifically designed as part of a system to engage with a support device of the system.

In aspects the invention is a system comprising an instrument designed for oral engagement and designed to also engage with a support device to secure the instrument in a reliable location when not in use. In aspects the system can comprise additional components such as one or more monitoring, alert, or audio and/or visual communication components.

In aspects, the invention is a method for securing an instrument for oral engagement in a reliable location such that during a period of time in which a caretaker is unavailable, a user can reliably locate one or more instruments, such as for example during a night time period when an infant is confined to a crib.

In aspects, the invention described herein is a suspension mechanism for instruments designed to relieve sucking stress wherein an accessible position of the oral instrument is maintained when the oral instrument is not in use through the binding of an adhesive material within the oral instrument and a counter-adhesive material of a counterpart adhesive component, whereby such suspension is releasable, or may be disengaged, through the application of a manual force.

DETAILED DESCRIPTION OF THE INVENTION

Figure 1:
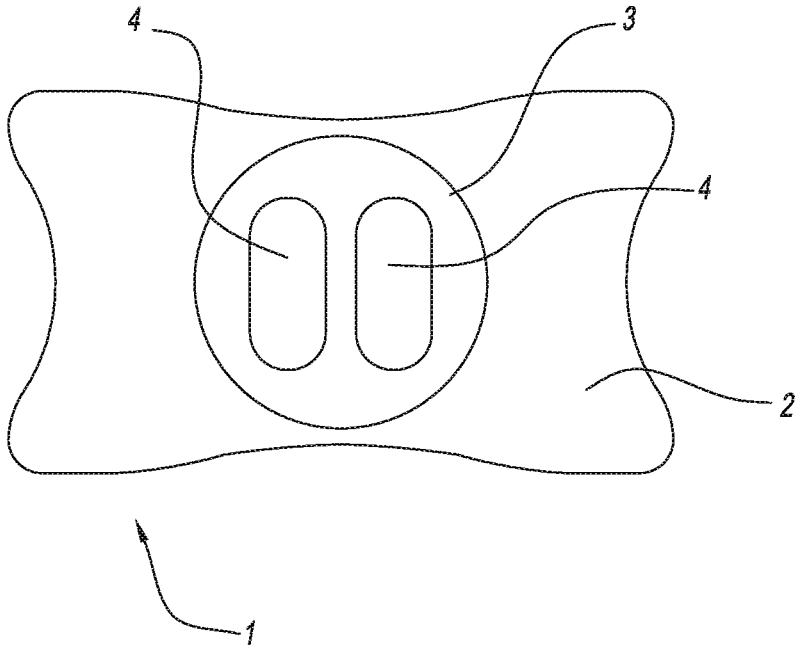
FIG. 1 provides an illustration of an exemplary instrument (a pacifier) suitable for use in the system and method of the invention.

Disclosed herein are instruments for oral engagement with mammals, and their related systems and methods of use, including mechanisms for maintaining the position of such oral engagement instruments when not in use such that they can be retained in an accessible position for the user until sought and/or disengaged by a user.

Principles of Construction

The use of the terms "a" and "an" and "the" and similar referents in the context of describing the invention are to be construed to cover both the singular and the plural, unless otherwise indicated herein or clearly contradicted by context.

Unless otherwise stated, all exact values provided herein are representative of corresponding approximate values (e.g., all exact exemplary values provided with respect to a particular factor or measurement can be considered to also provide a corresponding approximate measurement, modified by "about," where appropriate). All provided ranges of values are intended to include the end points of the ranges, as well as values between the end points.

The description herein of any aspect or embodiment of the invention using terms such as "comprising", "having," "including," or "containing" with reference to an element or elements is intended to provide support for a similar aspect or embodiment of the invention that "consists of", "consists essentially of", or "substantially comprises" that particular element or elements, unless otherwise stated or clearly contradicted by context (e.g., a composition described herein as comprising a particular element should be understood as also describing a composition consisting of that element, unless otherwise stated or clearly contradicted by context).

All headings and sub-headings are used herein for convenience only and should not be construed as limiting the invention in any way.

The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

The citation and incorporation of patent documents herein is done for convenience only and does not reflect any view of the validity, patentability, and/or enforceability of such patent documents.

This invention includes all modifications and equivalents of the subject matter recited in the claims and/or aspects appended hereto as permitted by applicable law.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but rather should be defined only in accordance with the following claims and their equivalents.

Description and Embodiments of the Invention

The invention described herein comprises, in one aspect, an instrument suitable as a sucking device for juveniles, such as a baby/toddler pacifier, or e.g., an infant teether, which comprises (a) an oral engagement component, such as sucking component, e.g., an artificial nipple made of an orally safe material that is safely bound to one or more other parts of the instrument in a manner such that it is not released even after repeated use and washing (including dishwasher washing), the type of which are commonly used in pacifiers or a teething ring body and (b) a body made of an orally safe material comprising (i) safety component or safety means (i.e., one or more guard components) for preventing swallowing of the instrument by the user (e.g., the type of "wing" guard component that rests on an infant's lips in pacifiers commonly marketed today) (in the case of a teething ring-type device the body of the device serves as both the safety component and the sucking component) and, optionally, (ii) a core component that binds to the guard component/safety means and sucking component and which optionally may include a handle for the user, which may optionally include other attachments, such as a ring component, and (c) one or more interior areas that contain an adhesive material, the interior areas configured to retain the adhesive material without release after repeated user use and washing (including vigorous washing, such as in a typical home commercial dishwasher). In aspects, the one or more interior areas are associated with one or more openings, such that the instrument comprises one or more exposed areas. In such embodiments, the one or more exposed areas can be configured to receive corresponding counter-adhesive materials, which may in some embodiments extend below the surface of the surrounding areas of the instrument to bind the adhesive material. In other aspects the instruments lack exposed areas or at least some of the interior areas are not exposed. For example, where the adhesive material is or comprises a magnetic material it can be the case that the magnetic material is contained within the surface of the instrument, but the instrument is configured such that the magnetic force associated with the material allows the material to still bind to the counter-adhesive material with the desired force. In other cases, where, e.g., a hook-and-loop binding system is used, exposure to the adhesive material part of the hook-and-loop system will typically include openings exposing the adhesive material to the counter-adhesive material. The instrument can be a pacifier (sometimes called a binky, a dummy, or even a plug) or another device suitable for sucking, such as a teething ring. Such instruments typically ease sucking instincts (and sucking stress) in infants/toddlers, but also can be used to reduce the symptoms of colic, teething, and may even reduce the incidence of SIDS, reduce the likelihood of juvenile ear pain, and/or promote oral hygiene. In one aspect, the device lacks a hanging or suspended grabbing ring structure (the type of which are often part of classic pacifiers).

In aspects, the instrument may be "freestanding", independent of any association with any other device (such as a ribbon, extended cord, blanket, or toy). In another aspect the instrument may be associated with an attachment. In aspects, the attachment is configured such that the attachment can be engaged or disengaged from the instrument. In such facets the attachment may be a relatively small attachment, such as an attachment that is smaller than an infant blanket, less than about 11 inches, less than about 10.5 inches, less than about 10 inches, less than about 9 inches, less than about 8.5 inches, less than about 8 inches, less than about 7 inches, less than about 6 inches, less than about 5.5 inches, less than about 5 inches, less than about 4.5 inches, less than about 4 inches, about 3 inches or less, about 2 inches or less. The systems of the invention typically will comprise a surface (e.g., a surface of an attachment) that can contain more than one instrument, such as 2, 3, 5, 6, 7, 8, 9, 10 or more instruments, such as pacifiers; however in most embodiments the surface will be less than 11 inches in any dimension, such as less than 10.5 inches in any dimension, less than about 10 inches in any dimension, or even smaller in size, such as less than about 9.5, less than about 9, less than about 8.5, less than about 8, less than about 7, or less than about 6 inches in area that is exposed to the area in which the infant/toddler is confined when the system is typically in use. In aspects, such an attachment can be referred to as a support device.

The instrument can comprise any suitable number of exposed interior areas. In one aspect, the instrument comprises at least two exposed interior areas. In another aspect the instrument comprises 3 or more, 4 or more, 5 or more, 7 or more, or even 10 or more exposed interior areas, such as, for example, 1-100 exposed interior areas, 1-50 exposed interior areas, 2-40 exposed interior areas, 1-20 exposed interior areas, 2-20 exposed interior areas, 3-20 exposed interior areas, 2-15 exposed interior areas, 2-12 exposed interior areas, 3-10 exposed interior areas, 2-10 exposed interior areas, 2-8 exposed interior areas, 2-6 exposed interior areas, or 2-5 exposed interior areas. Typically, the exposed areas will be sized less than about 8 mm in planar diameter (with respect to the surrounding surface of the instrument), such as about 7.5 mm in diameter or less, about 7 mm in diameter or less, about 6.5 mm in diameter or less, about 6 mm in diameter or less, about 5.5 mm in diameter or less, about 5 mm in diameter or less, or can even comprise smaller diameters such as about 2.5 mm in diameter or about 1 mm in diameter. The one or more exposed areas can be located in the core section, the guard section, or both sections. Typically, the exposed areas will at least be partially contained in the core section. In some embodiments the exposed area(s) are entirely contained in the core section or at least about 75%, at least about 90%, or at least about 95% of the exposed area by number and/or by total area of the exposed area(s) are located in the core section of the instrument. It can be possible, however, that the instrument lacks distinct core and guard sections, such as in the case where the instrument is a teething ring. In such cases the device can only include a guard component or section that prevents swallowing of the instrument by the user.

In some aspects, the one or more exposed areas can be located in a position such that if user removes the instrument from their mouth with intention, such that their hand grasps a section of the device which is outside of their oral cavity when the instrument is in use, the instrument does not need to be repositioned in order to be secured to a support device; that is, the one or more exposed areas is positioned on the instrument in an area generally not covered by the user's hand when the instrument is removed from the user's mouth.

In aspects, the instrument can be composed of any suitable material. Examples of non-toxic and orally safe materials that can be subjected to repeated use and washing and thus used in the safety/guard component, oral engagement component, and/or core component, if present, can include latex, silicones, and hard plastics (in some aspects the material lacks latex or comprises less than about 25%, less than about 15%, or less than about 5% latex). In some cases, the instrument is composed of separate components that are bound together. In other aspects, the instrument is formed as a single piece product. The materials are typically materials approved for use in the context, such as materials approved for pacifiers by the United States Consumer Product and Safety Commission (e.g., is in compliance with United States Consumer Product Safety Commission's Requirements for Pacifiers; see, e.g., 16 CFR 1511). In one context the material can be characterized as chemically inert, stable at high temperatures, and able to resist oxidation, particularly at levels better than latex. In other contexts, the material is capable of remaining integrity over several boiling and cooling cycles better than latex.

An exposed interior area associated with an instrument of the invention can be a hollow or partially hollow (or hollowed-out or cut-away) area of an instrument, such as a pacifier, or a solid, but recessed portion of a pacifier/instrument, or any suitable combination thereof. In any case, the interior area will be designed/configured to contain an interior adhesive material. The interior adhesive material can be any suitable type of adhesive material. Given the context of the invention the interior adhesive material should be non-toxic. The interior adhesive material will typically be bound to a surface of one or more interior exposed areas of the instrument, such as through a glue or other means of binding. The binding means used to bind the adhesive material to the interior of the instrument can be any suitable binding means, but will typically be of sufficient strength that even under a force equivalent or greater to that which would be expected with repeated sucking even over a period of several months or even years the material will not release in at least 99.9%, or more typically at least 99.99%, 99.999%, 99.9999%, or 99.99999% of cases. In one embodiment, the instrument, including any bound interior adhesive material is suitable for dishwashing in a typical machine dishwasher. The adhesive material and binding also or alternatively can more generally be suitable for use in water environments such as bathtubs, baby pools, water play areas, and the like. In another aspect, the instrument, adhesive, and binding are capable of going through a washing machine repeatedly without degradation, in at least 95%, such as at least 98%, at least 99%, at least 99.9%, or more typically at least 99.99%, 99.999%, 99.9999%, or 99.99999% of cases. Materials and adhesive that are capable of such levels of functionality are known in the art and can be selected by those of skill in the art without any need for undue experimentation. The effect of binding may be accomplished or, more typically, aided, by the configuration of the device, for example by configuring the size of the interior exposed areas and the adhesive material such that once the adhesive material is enclosed in the instrument it cannot be easily pulled through the interior exposed areas. This effect may be accomplished, for example, by using an instrument composed of two or more parts that can be bound together, typically selectively bound together, such as through gluing, strongly snapping, or otherwise sealing/binding the parts of the instrument, and the adhesive material can then be inserted into the instrument prior to final assembly of the instrument. In one context, the instrument is produced by a method that complies with current standards of suitability for similar instruments, such as infant pacifiers, resisting falling apart for example when subjected to a number of tests used as quality control measures for pacifiers (e.g., the instruments are subjected to industry standard "pull tests", such as subjecting the instrument to at least about ten pounds (4.5 kg) of pressure for a sustained period of time).

The adhesive will typically be a reusable adhesive material that once placed (adhered to an intended binding surface/device) can support the instrument in a resting state for a period of at least one week without further input. However, the adhesive material should also bind the binding surface with a strength that is low enough that the instrument will release upon typical pulling by an infant and/or a toddler. Typically, the exposed side of the adhesive material will comprise a portion which provides this functionality. While the adhesive can be any suitable type of adhesive and the binding surface/device can be any suitable surface/device, a hook-and-loop adhesive system, such as a Velcro-type system, can readily achieve the requirement of the binding system and represents a preferred aspect of the invention. In some embodiments the one or more pieces of adhesive material will be sized larger than the corresponding one or more exposed areas, such that even if the adhesive material becomes loose or detached it remains difficult for the user to remove the adhesive material from the instrument. Thus, for example, in one embodiment the one or more adhesive material parts may be at least 110%, at least 125%, at least 133%, at least 150%, at least 175%, or even at least 200% the size of the corresponding exposed areas. A system of the invention can include instructions to a caretaker of the user to check for the integrity of the adhesive material on a regular basis. A mobile application or other reminder system can be provided with the system or the system may include some type of time or use indicator, such as a color changing component, which reminds caretakers to check for the integrity of the adhesive material and/or to discard and replace instruments after a given amount of time or given amount of exposure to certain conditions, such as washing or use. In aspects, the adhesive material within the interior areas which does not bind to, e.g., a handle or other component of the oral engagement component itself. In aspects the adhesive material within the interior areas is designed to attach only to a support device which can itself be fixed or bound such that the support device is relatively immobile once placed (unless, e.g., intentionally repositioned or relocated by, e.g., a caretaker), thus providing a reliable location for the adherence of an oral engagement component.

In aspects, an instrument can comprise an adhesive which is not exposed through an access to an interior portion of the instrument. In aspects, an instrument can comprise a material which itself serves as an adhesive, such as for example a component of the instrument is made of a material which is magnetic, such a magnetic material being a material deemed safe for use. In aspects, for example, such a material can be a plastic having a magnetically active material mixed within it. In aspects, such an instrument can be one component of a system in which the adhesion between component and devices of the system is magnetic, wherein one adhesive component of the magnetic system (e.g., a magnet or a composition comprising magnetized material) is present in a molded nub or button like area of a pacifier, and a second adhesive component, such as a magnetic surface, is present in a surface of a support device. In alternative aspects, the magnetic adhesive of the instrument can be attained by placement of a magnet within, for example, an oral engagement component (e.g., a nipple) of the instrument (e.g., a pacifier), such that the strength of the magnet can extend through the material of the oral engagement component and bind reversibly to a counter-adhesive element of a support device, such a counter-adhesive being one that is attractive to the magnet. In aspects, the counter-adhesive component is of a strength which can extend through such material and bind reversibly to the adhesive element of an instrument.

As suggested already, in one aspect the invention provides a system comprising an instrument, such as a pacifier, as described above, and one or more support device(s) comprising a surface comprising a counter-adhesive material. The support device surface may be any suitable size, provided it can bind at least one instrument. Typically, the support device is large enough to hold a plurality of instruments. Commonly, the counter-adhesive material will be of a length that makes it capable of penetrating the exposed areas and will, at least primarily, is not substantially completely, binds to the interior adhesive material below the surface of the instrument at the outer edge of the interior exposed area(s).

The support device will be configured to bind one or more types of structures or surfaces that will be suitable for placement of instruments in one or more areas where an infant or toddler is temporarily confined. Such an area might be, for example, a crib, a playpen, a play area, or some other confined area. The support device can bind to such structures, for example one or more bars of a crib or playpen, by any suitable means. In aspects, the support device is designed such that the instrument cannot be used when the instrument is bound to the support device. In aspects, the instrument remains stationary (e.g., it does not fall due to gravity, does not move from one location to another, or also or alternatively remains relatively fixed in space) when attached to a support device (e.g., when not in use). In one aspect, the support device comprises two or more ties or loop structures that can be used to bind the support device to a structure, such as the side of a crib. In another aspect, the support device can comprise a wrap-around functionality/structure, such as by another hook-and-loop binding that allows the support device to snugly wrap around a bar of a crib or other structure in a way that it will not move when pulled upon by the infant/toddler, but will release the bound instruments to the infant/toddler. The support device may further be characterized in lacking any retentive clamps. The support device also may be characterized by having a size such as those described above (e.g., having no dimension greater than 10 inches in length).

In addition to instruments and systems it will be clear that the invention further provides methods of retaining one or more instruments, typically more than one instruments, in a manner that is releasable to an infant/toddler, based on manual force of the infant/toddler, and thereby easing sucking stress/instinct in the infant/toddler. When the adhesive material of the instrument (e.g., the one or more adhesive material components of a system) engages the counter-adhesive material (e.g., a support device comprising one or more counter-adhesive material components) the device will be retained (suspended) (i.e., gravitationally) and will typically not spontaneously release from the suspended position for at least about 3 days, at least about 5 days, at least about one week, at least about two weeks, at least about three weeks, at least about a month, or even longer than about one month unless disengaged by user force. In other words, the instrument once suspended by engagement with a sufficient amount of a counter-adhesive material will not "fall" from position unless actively disengaged, e.g., by a user. However, the instrument will be releasable based on user interaction, usually due to pulling. Thus, for example, the strength of the interaction between the adhesive material component(s) and counter-adhesive material component(s) will be such that the user of interest—e.g., an infant/toddler, pet, or person with special needs—will be able to pull the instrument from the support device or other structure comprising the counter-adhesive material component(s) of the system. Such systems are another aspect of the invention. Systems comprising suitable support devices and instruments of the invention can be provided as a unit package to provide a complete solution for users or their caretakers. Both components of the system should be orally safe and configured to be stably reusable after repeated oral use and user interaction and repeated washing, including washing through dishwashing, boiling, autoclaving, and/or hand washing. The disclosure provided herein will also make it clear that various methods of using the devices or systems of the invention are another aspect of the invention. Systems of the invention can be used in methods for maintaining the positioning of any type of device for oral engagement. The use of such systems for infants and toddlers, for example, can aid in enhancing infant/toddler (and caregiver) sleep and even reduce the risk of SIDS by allowing reliable access to instruments for oral engagement, such as a pacifier or a teething ring.

The following exemplary embodiments of the invention are intended to further illustrate the various aspects of the invention, without limiting it in any way.

In a particular aspect, as shown below in FIG. 1, an instrument (embodied as a pacifier), 1, is provided, which is in the form of a typical pacifier comprising a button like area, 3, and wing areas, 2, which render the pacifier resistant to swallowing by the infant/toddler that uses the instrument. In this exemplary embodiment the button area comprises two exposed interior areas, 4, in the form of recessed areas that open to either a hollow portion of the button area or a solid depression in the button area.

Figure 2:
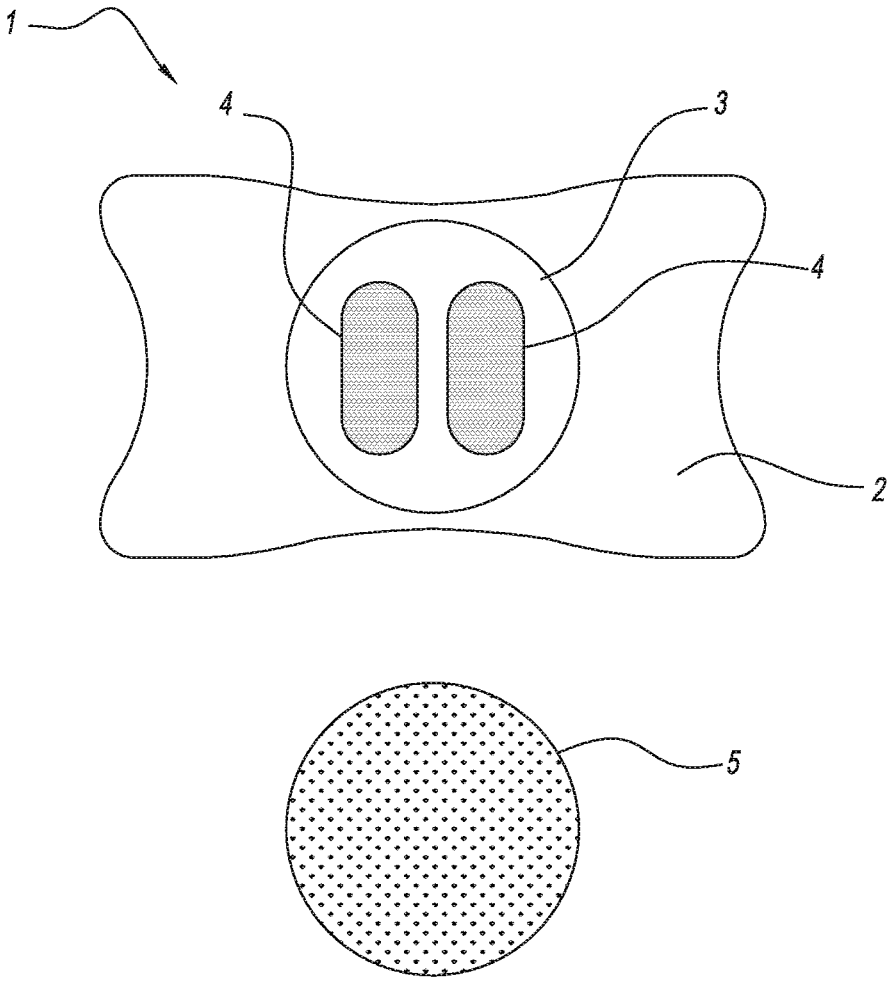
FIG. 2 illustrates an adhesive filling and the pacifier of FIG. 1 containing such an adhesive filling for use in accordance with the principles of the present invention.

As shown in FIG. 2, in one embodiment, the pacifier, 1, can be associated with a replaceable adhesive component, 5, which can comprise an adhesive surface, typically on one side, such as a hook-and-loop adhesive (e.g., made of a Velcro-like material). The adhesive component, 5, can be inserted into the pacifier, 1, such that a portion of the adhesive component is exposed through the inner exposed areas, 4, located in the button area, 3, of the pacifier. The adhesive component can be bound to another hook-and-loop structure contained inside the pacifier (not shown) or bound by other means, and the relative configuration of the exposed area, 4, and the adhesive component, 5, may force or aid in the retention of the adhesive component within the exposed area, even when exposed to the sucking of the infant/toddler or other forces, such as washing in a dishwasher or washing machine. Thus, the pacifier, 1, may be capable of being separated in parts, such that the adhesive component, 5, can be inserted, prior to the instrument being reassembled, such as through strongly adhesive snapping (not shown), thereby holding the adhesive material secured in the instrument, while also keeping the instrument together to avoid any risk of choking or other problems when in the possession of the toddler/infant.

The pacifier instrument illustrated in FIG. 2 can be associated with a support device that is used to hold one, two, three, four, five or more of the pacifiers in place in a crib, playpen, or other structure that is associated with temporary confinement of the infant/toddler.

Figure 3:
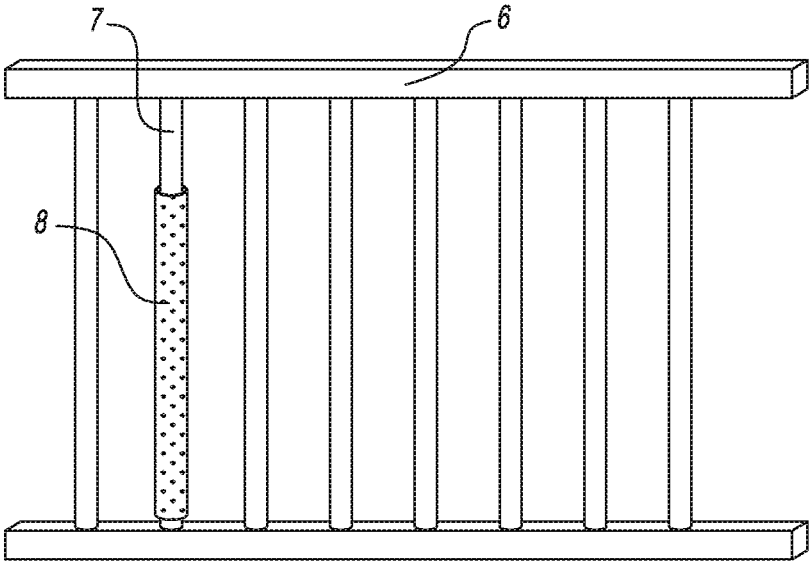
FIG. 3 depicts a counterpart adhesive section that can releasably bind to a pacifier system such as the one depicted in FIG. 2.

FIG. 3 provides an illustration of an exemplary support system, which is a wrap-around support system, 8, which might be a self-closing foam tube or a tube that adheres through a hook-and-loop binding system or other suitable means. Such a support device can wrap around structures, such as a support bar, 7, of a crib, 6, providing a surface to which two, three, four, or more pacifiers can be attached, thereby providing the infant/toddler with a reliable place to find a pacifier if desired, for example in the middle of the night, even when the infant toddler loses two, three, or more pacifiers in the course of the evening or other period of temporary confinement.

Figure 4:
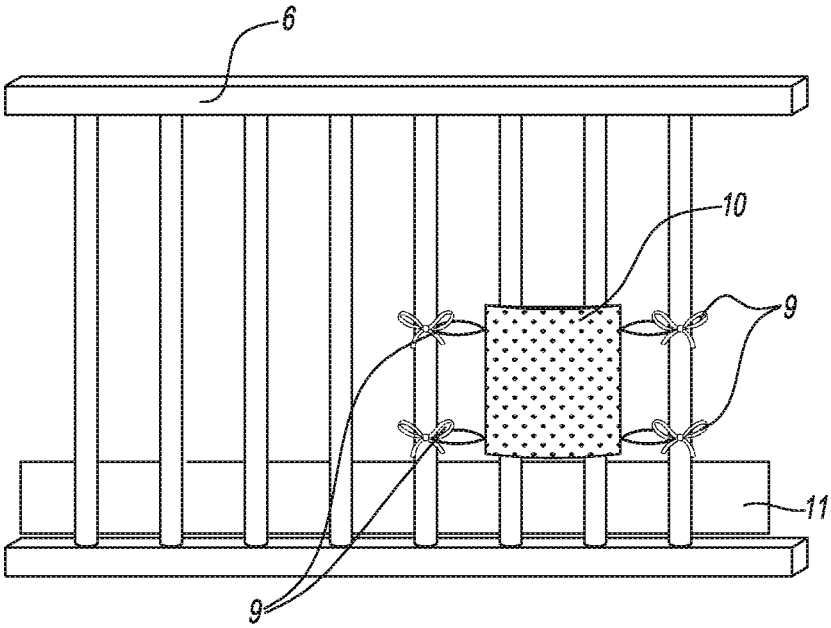
FIG. 4 depicts another counterpart adhesive section that can releasably bind to a pacifier system such as the one shown in FIG. 2.

An alternative support device is shown in FIG. 4, wherein the support device comprises a surface, 10, which comprises or is formed essentially entirely from a counter-adhesive or adhesive material, such as the counterpart in a hook-and-loop adhesive system to the adhesive contained in the pacifier, and a plurality of ties or loop structures, 9, which allow the surface to be securely tied to the bars, 6, of the crib, at a position above the mattress, 11, placed in the bottom of the crib.

Figure 5:
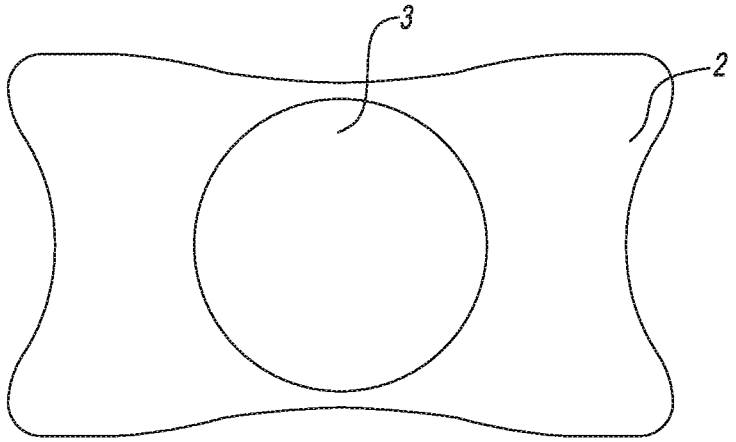
FIG. 5 provides an illustration of an exemplary pacifier suitable for use in the system and method of the invention.

An alternative embodiment of a pacifier is shown in FIG. 5, wherein the molded nub or button-like area, 3, is present along with wings, 2, like the instrument (pacifier) exemplified in FIG. 1, however the molded nub or button-like area, 3, lacks any exposed internal area.

Figure 6A:
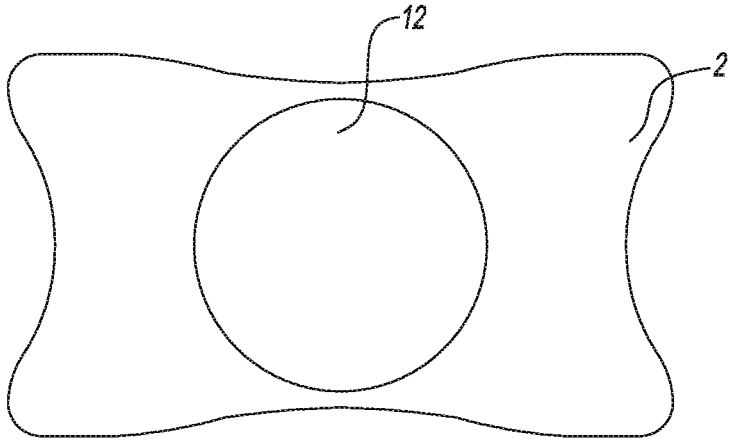
FIGS. 6A and 6B provide illustrations of embodiments of an adhesive mechanism of a pacifier suitable for use in the system and method of the invention both of which utilize a magnetic adhesion system.

FIG. 6A illustrates an exemplary embodiment of an instrument (embodied as a pacifier like that illustrated in FIG. 5), having wings, 2, and a molded nub or button-like area, wherein the material of the molded nub or button-like area (previously labeled 3) comprises a slightly magnetic material. The slightly magnetically active molded nub or button-like area, 12, in FIG. 6A, serves as an adhesive component and is capable of interacting with a counter-adhesive component of a support device so as to be capable of maintaining a suspended position of the pacifier until sought and/or disengaged by a user.

Figure 6B:
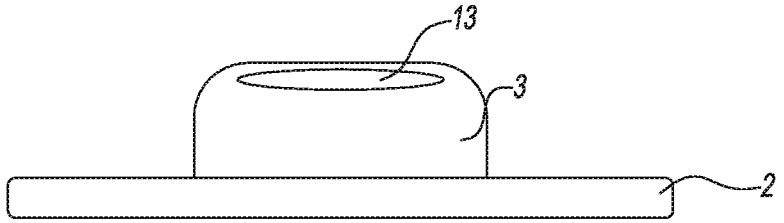

FIG. 6B illustrates a similar embodiment of an instrument (a pacifier) like that illustrated in FIG. 6A, however 6B illustrates a pacifier having wings, 2, and a molded nub or button-like area, 3, with or without an exposed internal area, wherein a magnet, 13, is positioned inside of the molded nub or button-like area, 3. The magnet, 13, serves as an adhesive component and is capable of interacting with a counter-adhesive component of a support device so as to be capable of maintaining a suspended position of the pacifier until sought and/or disengaged by a user.

Figure 7:
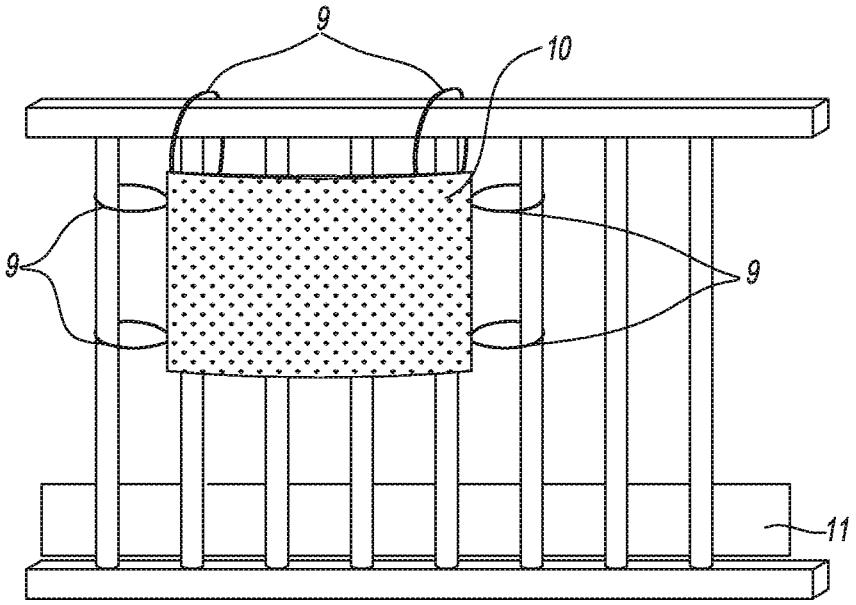
FIG. 7 illustrates a counterpart adhesive section that can releasably bind to a pacifier such as the one depicted in FIGS. 6A and 6B.

FIG. 7 illustrates an exemplary support device comprising a surface, 10, and a plurality of ties or loop structures, 9. Ties and loop structures, 9, serve to maintain the stable position of the surface, 10, of the support device, such that it remains in an accessible position to, for example, an infant confined in a crib to which the support system is attached, such as above a mattress, 11, of such a crib enclosure. In this embodiment, surface, 10, of the support device comprises a counter-adhesive to the adhesive material of one or more instruments, e.g., pacifiers such as those of FIGS. 6A and 6B, such as a magnetic material. The magnetic nature of surface, 10, is capable of interacting with the adhesive component of the molded nub or button-like area of the instrument so as to be capable of maintaining a suspended position of the instrument (e.g., pacifier) until sought and/or disengaged from the support device by a user.

Figure 8:
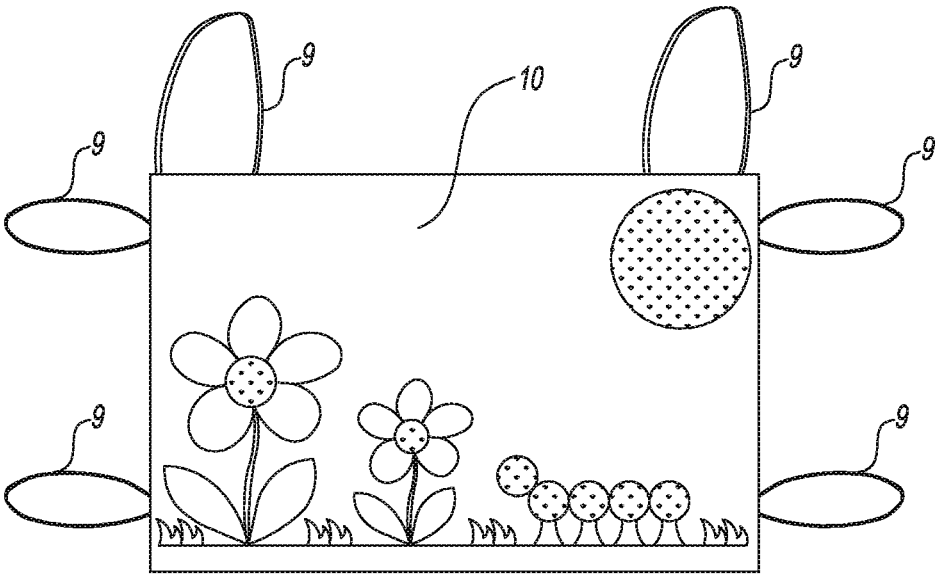
FIG. 8 illustrates one exemplary embodiment of a counterpart adhesive section capable of releasably binding to a pacifier such as the one depicted in FIGS. 6A and 6B.

FIG. 8 illustrates one embodiment of an exemplary support device comprising a decorated surface, 10, and a plurality of ties or loop structures, 9. Such a decorated surface can comprise any pattern or visual or textural decoration, e.g., an image or scene which may comprise a primarily even or flat surface or which may alternatively comprise one or more elements which are raised above one or more other elements), whereby the entire surface, 10, or specific elements shown in the decorative surface, such as a specific image or specific elements of a decoration or scene, e.g., the flower, sun, or caterpillar images of a nature scene like that embodied in FIG. 8, comprises a counter-adhesive to the adhesive material of a molded nub or button-like area of an instrument, e.g., a pacifier or teething ring. The counter-adhesive material can interact with the adhesive component of the oral engagement component to be capable of maintaining a suspended position of the instrument until sought and/or disengaged by a user.

Figure 9:
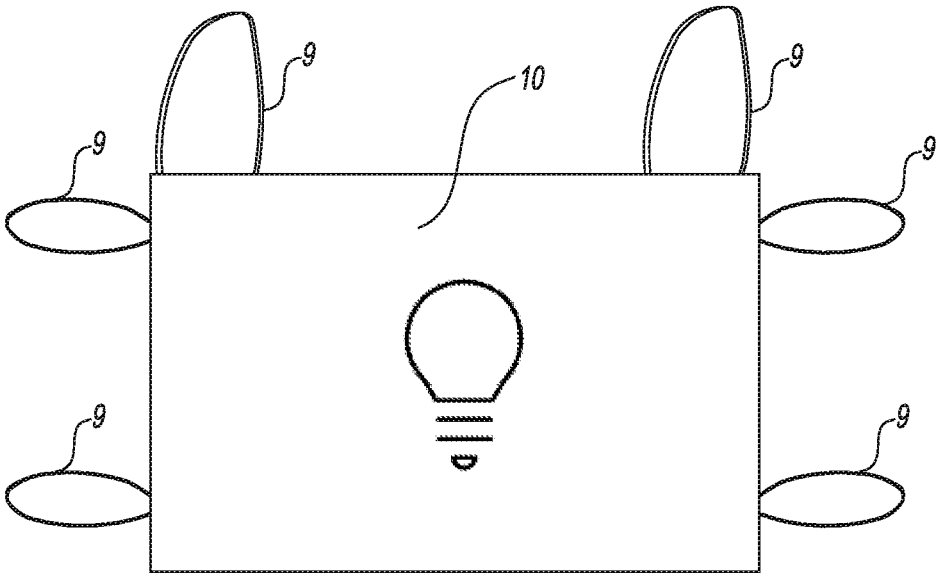
FIG. 9 provides a conceptual representation of one embodiment of a counterpart adhesive section capable of releasably binding to a pacifier such as the one depicted in FIGS. 6A and 6B.

FIG. 9 illustrates one embodiment of an exemplary support device comprising an illuminated surface, 10, and a plurality of ties or loop structures, 9. The illuminated surface can comprise an illumination device, such as a screen, one or more individual lights or, e.g., a string of lights, or the like which serve to provide an illuminated surface which further comprises a counter-adhesive to the adhesive material of a molded nub or button-like area of an instrument, e.g., a pacifier. The illuminated surface can in aspects provide visual stimulation, calming visual interaction, or other types of visual interest to a support device. The counter-adhesive material of the support device is capable of interacting with the adhesive component of the molded nub or button-like area so as to be capable of maintaining a suspended position of the instrument (e.g., pacifier) until sought and/or disengaged by a user. The illumination can be provided by a separate component or device, such as for example an electronic pad or phone-like device.

In aspects the illuminating component of a support device illustrated in FIG. 9 can operate independently of the components, devices, and systems described herein. In aspects the illuminating component can be a component of a system (e.g., along with an instrument comprising an oral engagement component and a support device). Also or alternatively, the illumination can be provided by a component integral (e.g., which operates as a single component) with the surface, 10, of the support device. The illumination can in aspects lie beneath a semi-transparent or transparent cover which comprises the counter-adhesive material. In certain embodiments, the illuminating component can further comprise one or more components which provide enhanced functionality, such as sound, e.g., music, or can for example provide communication devices such as visual monitoring (e.g., through the incorporation of one or more cameras, audio communication (e.g., through the incorporation of one or more microphones and/or one or more speakers), and the like, such enhanced functionality for infant/toddler monitoring and interaction being well known in the art.

Exemplary Aspects of the Invention

The following non-limiting list of exemplary aspects is meant to further illuminate certain embodiments of the invention. Any one or more of these aspects can be combined with any other aspect, facet, or embodiment of the invention described in any other portion of this disclosure.

In aspects, the invention provides a system for maintaining an instrument comprising an oral engagement component in a suspended position comprising (I) an instrument comprising an oral engagement component that is both safe for repeated cleansing and capable of repeated oral use by a mammalian user, the instrument comprising (a) one or more interior areas that are recessed with respect to a surface of the instrument, and (b) one or more reusable, non-toxic adhesive material components positioned in the one or more interior areas, the adhesive material configured to engage a counter-adhesive material of a support device; and (II) a support device comprising a counter-adhesive material to the adhesive material of the instrument, wherein the adhesive material of the instrument and the counter-adhesive material of the support device are configured to bind to one another to retain the instrument in a suspended position without spontaneous release when the instrument is subjected to repeated daily user use, dishwashing, or both, for a period of at least one week, but permitting the adhesive and counter-adhesive material to disengage from one another when the user pulls the instrument away from the support device, and further wherein when the instrument is engaged with the support device, the instrument is not usable (aspect 1).

In aspects, the invention provides the system of aspect 1, wherein the instrument comprises a plurality of openings to the one or more interior areas, such that the interior areas comprise one or more exposed areas, wherein the one or more exposed areas are configured to receive the counter-adhesive of the support device when the counter-adhesive material of the support device binds to the adhesive material of the instrument (aspect 2).

In aspects, the invention provides the system of aspect 1 or aspect 2, wherein the adhesive material comprises one part of a hook-and-loop adhesive system (aspect 3).

In aspects, the invention provides the system of aspect 1 or aspect 2, wherein the adhesive material comprises one part of a magnetic adhesive system (aspect 4).

In aspects, the invention provides the system of any one of aspects 1-4, wherein the instrument is a teething ring (aspect 5).

In aspects, the invention provides the system of any one of aspects 1-5, wherein the instrument is a pacifier comprising a guard component, a core component, and a sucking component, wherein the one or more exposed areas and the corresponding one or more adhesive material components are contained in the core component, the guard component, or both (aspect 6).

In aspects, the invention provides the system of aspect 6, wherein the instrument lacks a ring handle component (aspect 7).

In aspects, the invention provides the system of aspect 6, wherein the adhesive material of the instrument does not bind to a core or handle component of the pacifier (aspect 8).

In aspects, the invention provides the system of any one of aspects 1-8, wherein the instrument comprises a core or handle component and the core or handle component is a stable, fixed component that does not move in position relative to other parts of the instrument (aspect 9).

In aspects, the invention provides the system of any one of aspects 1-9, wherein the instrument is removable from the support device by application of a force that is significantly less than average adult human pulling force (aspect 10).

In aspects, the invention provides the system of aspect 10, wherein the instrument is removable by application of a force exerted by typical infant pulling (aspect 11).

In aspects, the invention provides the system of aspect 10, wherein the instrument is removable by application of a force exerted by typical pet pulling, typical pet pulling, typical toddler pulling, or both (aspect 12).

In aspects, the invention provides the system of any one of aspects 1-12, wherein the instrument comprises a guard component and at least most of the adhesive material is oriented in the same manner (plane of orientation) as the guard component (e.g., the adhesive material mostly, at least 75%, at least 90%, or entirely is oriented as strips or sheets facing outward towards one side of the guard component, rather than, e.g., being perpendicular to the guard component or at an angle to the guard component of more than 30 degrees) (aspect 13).

In aspects, the invention provides the system of any one of aspects 1-13, wherein the support device surface is configured to simultaneously hold a plurality of instruments (aspect 14).

In aspects, the invention provides the system of any one of aspects 1-14, wherein the instrument comprises one or more areas of adhesive material each of which being at least 125% the size of the corresponding one or more exposed areas and wherein the one or more exposed areas are less than 7 mm in diameter (aspect 15).

In aspects, the invention provides the system of aspect 15, wherein the one or more exposed areas are less than 5 mm in diameter (aspect 16).

In aspects, the invention provides the system of any one of aspects 1-16, wherein the instrument comprises an adhesive material which a) is incorporated into a material of the instrument structure itself, b) resides within a non-exposed interior portion of the instrument, and c) is capable of exerting a force through the material of the instrument such that it may adhere to a counter-adhesive surface (aspect 17).

In aspects, the invention provides the system of any one of aspects 1-17, wherein the support device is configured to releasably bind to one or more bar components of a crib, playpen, or both (aspect 18).

In aspects, the invention provides the system of any one of aspects 1-18, wherein the support device lacks any retentive clamp and comprises a tie-on mat or a wrap-around device (aspect 19).

In aspects, the invention provides the system of any one of aspects 1-19, wherein the surface of the support device to which one or more instruments is attached is no more than 10 inches in size in any dimension (aspect 20).

In aspects, the invention provides the system of any one of aspects 1-20, wherein the instrument is a pet toy or is bound to a pet toy (aspect 21).

In aspects, the invention provides the system of any one of aspects 1-21, wherein the one or more instruments each comprise an indicator when use of the instrument should be discontinued (aspect 22).

In aspects, the invention provides an instrument having any features of the instruments of any one of aspects 1-22 (aspect 23).

In aspects, the invention provides a system comprising an instrument comprising a) an oral engagement component and further comprising an adhesive component; and b) a support device comprising a surface comprising a non-toxic counter-adhesive material bound to the support device such that the counter-adhesive material is not released from the support device when subjected to repeated daily user use, dishwashing, or both and that will repeatedly bind to the adhesive material of the instrument and support the instrument when the instrument, support device, or both are subjected to daily use, dishwashing, or both; wherein the adhesive material and counter-adhesive material bind with a force capable of supporting the instrument in an elevated position for at least one week for at least one month of use but will manually release from the support device upon user pulling on the instrument, and further wherein when the instrument is engaged with the support device, the instrument is not usable (aspect 24).

In aspects, the invention provides the system of aspect 24, wherein the support device surface is configured to hold a plurality of instruments (aspect 25).

In aspects, the invention provides the system of aspect 24 or aspect 25, wherein the instrument comprises one or more open areas exposing an interior of the instrument housing the adhesive component of the instrument, and the counter-adhesive material of the support device is capable of penetrating one or more exposed areas of the instrument and at least primarily bind to the adhesive material of the instrument at a point below the outer surface of the instrument surrounding the one or more exposed areas (aspect 26).

In aspects, the invention provides the system of any one of aspects 24-26, wherein the instrument comprises one or more areas of adhesive material each of which being at least 125% the size of the corresponding one or more exposed areas and wherein the one or more exposed areas are less than 7 mm in diameter (aspect 27).

In aspects, the invention provides the system of any one of aspects 24-27, wherein the one or more exposed areas are less than 5 mm in diameter (aspect 28).

In aspects, the invention provides the system of any one of aspects 24-28, wherein the instrument comprises an adhesive material which a) is incorporated into a material of the instrument structure itself, b) resides within a non-exposed interior portion of the instrument but is capable of exerting a force through the material of the instrument such that it may adhere to a counter-adhesive surface, or both (aspect 29).

In aspects, the invention provides the system of any one of aspects 24-29, wherein the support device comprises a tie-on mat (aspect 30).

In aspects, the invention provides the system of any one of aspects 24-30, wherein the support device comprises a wrap-around device (aspect 31).

In aspects, the invention provides the system of any one of aspects 24-30, wherein the support device lacks any retentive clamp (aspect 32.

In aspects, the invention provides the system of any one of aspects 24-32, wherein the surface of the support device to which one or more instruments is attached is no more than 10 inches in size in any dimension (aspect 33).

In aspects, the invention provides the system of any one of aspects 24-33, wherein the support device is configured to releasably bind to one or more bar components of a crib, playpen, or both (aspect 34).

In aspects, the invention provides the system of any one of aspects 24-34, wherein the instrument is a pet toy or is bound to a pet toy (aspect 35).

In aspects, the invention provides the system of any one of aspects 24-35, wherein the one or more instruments each comprise an indicator when use of the instrument should be discontinued (aspect 36).

In aspects, the invention provides the system of any one of aspects 1-36, wherein the instrument comprises more than 3, such as more than 5, such as more than about 10 exposed areas where adhesive material is accessible to counter-adhesive material of the support device (aspect 37).

In aspects, the invention provides an instrument having any of the features of the instruments described in any one of aspects 1-37 (aspect 38).

In aspects, the invention provides a method of maintaining the position of one or more instruments for mammalian oral engagement comprising adhering one or more, such as two or more, such as 5 or more of any of the instruments described in any one of aspects 1-37 to a support device described in any one of aspects 1-37 (aspect 39).

In aspects, the invention provides the method of aspect 39, wherein the method is performed to hold one or more pacifiers, teethers, or other orally engaging objects for an infant or a toddler (aspect 40).

In aspects, the invention provides the method of aspect 39, wherein the method is performed to hold one or more pet chew treats or other orally engageable toys or devices for one or more pets (aspect 41).

In aspects, the invention provides a method for maintaining the position of one or more instruments intended for oral engagement with a mammalian user comprising (a) providing one or more instruments suitable for oral engagement each of which comprising one or more exposed interior that each comprise a reusable non-toxic adhesive material that is configured to be accessed by and engagingly adhere to a counter-adhesive material and to releasably retain the instrument when the counter-adhesive material engages the adhesive material and (b) binding the instrument to a support device comprising the counter-adhesive material such that the one or more instruments are not spontaneously gravitationally released from the support device even when the instruments are subjected to repeated daily user use, dishwashing, or both, for a period of at least one week, and wherein the one or more instruments are configured to be released from the support device when pulled upon by a user such that the user can independently detach the one or more instruments from the support device (aspect 42).

In aspects, the invention provides the method of aspect 42, wherein the one or more instruments comprise one or more human infant pacifiers (aspect 43).

In aspects, the invention provides the method of aspect 42, wherein the one or more instruments comprise pet toys (aspect 44).

In aspects, the invention provides the method of any one of aspects 42-44, wherein the one or more instruments comprise a plurality of instruments for an intended mammalian user (aspect 45).

In aspects, the invention provides the method of any one of aspects 42-45, wherein the instrument, support device, or both, incorporate one or more additional features described in any one of aspects 1-37 (aspect 46).

In aspects, the invention provides an instrument for mammalian oral engagement comprising (1) an oral engagement component that is both safe for repeated cleansing and capable of repeated oral use by a mammalian user, the instrument comprising (a) one or more interior areas that are recessed with respect to a surface of the instrument, and (b) an attachment component comprising one or more reusable, non-toxic adhesive material components positioned in the one or more interior areas, the adhesive material configured to engage a counter-adhesive material of a support device (aspect 47).

In aspects, the invention provides the instrument of aspect 47, wherein the instrument comprises a plurality of openings to the one or more interior areas, such that the interior areas comprise one or more exposed areas, wherein the one or more exposed areas are configured to receive the counter-adhesive of the support device when the counter-adhesive material of the support device binds to the adhesive material of the instrument (aspect 48).

In aspects, the invention provides the instrument of aspect 47 or aspect 48, wherein the instrument is a baby pacifier comprising (i) a guard component and (ii) a core or handle component that maintains a fixed position in use, and (iii) the attachment component is located in the interior of the core or handle component, the guard component, or both (aspect 49).

In aspects, the invention provides the instrument of any one of aspects 47-49, wherein the instrument does not comprise any loops or ribbons as part of the attachment component (aspect 50).

In aspects, the invention provides the instrument of any one of aspects 47-50, wherein the instrument incorporates one or more features described in association with instruments described in any one of aspects 1-37 (aspect 51).

What is claimed is:

1. A system for simultaneously maintaining three or more instruments comprising an oral engagement component in a suspended position comprising:

(I) the three or more instruments, each of the three or more instruments comprising an oral engagement component that is both safe for repeated cleansing and capable of repeated oral use by a mammalian user, wherein the mammalian user can be an infant or a pet, and each of the three or more instruments further comprising (a) one or more interior areas that are recessed with respect to a surface of the instrument or are located within a part of the instrument, (b) one or more adhesive material components positioned in the one or more interior areas, the one or more adhesive material components comprising a reusable, non-toxic adhesive material and being configured to engage a counter-adhesive material on a surface of or contained within a support device, and (c) a plurality of openings to the one or more interior areas, such that the one or more interior areas comprise one or more exposed areas, wherein the one or more exposed areas are configured to receive the counter-adhesive material of the support device when the counter-adhesive material of the support device binds to the one or more adhesive material components and further wherein the one or more adhesive material components is at least about 125% the size of a corresponding exposed area of the one or more exposed areas; and (II) the support device, the support device (a) comprising the counter-adhesive material to the one or more adhesive material components of each of the three or more instruments and (b) being adapted to stably engage one or more stationary objects, such that when the support device stably engages the one or more stationary objects the support device remains in a fixed location, wherein the support device further (c) creates one or more surfaces when the support device stably engages the one or more stationary objects, wherein at least one of the one or more surfaces comprises the counter-adhesive material such that the one or more surfaces can simultaneously bind the three or more instruments, wherein (III) the one or more adhesive material components of each of the three or more instruments and the counter-adhesive material of the support device are configured to (a) repeatedly bind to and release one another, such that when a respective instrument of the three or more instruments is bound to the support device the respective instrument is retained in a suspended position without spontaneous release even when the respective instrument is subjected to repeated daily use by the mammalian user, dishwashing, or both, for a period of at least about one week and (b) permit the adhesive material of the respective instrument and the counter-adhesive material to disengage from one another when the user applies a manual force causing the respective instrument to pull away from the support device, and further wherein each instrument of the three or more instruments that engages the support device is maintained in a fixed position and has the same general orientation with respect to the one or more stationary objects as any other instrument of the three or more instruments that engages the support device.

2. The system of claim 1, wherein each of the one or more exposed areas is less than 5 mm in diameter.

3. The system of claim 1, wherein the three or more instruments comprise at least one instrument that is a pacifier, the pacifier comprising (a) a guard component, (b) a core or handle component, and (c) a sucking component, wherein (d) the guard component, core or handle component, and the sucking component are non-detachable from each other, (e) the one or more exposed areas and the corresponding one or more adhesive material components of the pacifier are contained in the core or handle component, the guard component, or both the core or handle component and guard component, and (f) the pacifier attaches to and detaches from the support device in its entirety.

4. The system of claim 1, wherein the support device is configured to bind to one or more bar components of a crib or a playpen in a releasable manner when acted on by an adult human user.

5. The system of claim 1, wherein the three or more instruments each comprise at least one indicator element, wherein the at least one indicator element of each of the three or more instruments provides adult human users with a discrete indication of when use of each of the three or more instruments should be discontinued.

6. The system of claim 1, wherein (a) at least part of the surface of the support device is made of a material that is different than the adhesive material of each of the three or more instruments and (b) the surface of the support device further comprises a plurality of spatially separated areas comprising the counter-adhesive material, wherein at least some spatially separated areas of the plurality of spatially separated areas vary in size with respect to one another.

7. A system for simultaneously maintaining three or more instruments, wherein the system comprises an oral engagement component in a suspended position comprising:

(I) the three or more instruments, each of the three or more instruments comprising an oral engagement component that is both safe for repeated cleansing and capable of repeated oral use by a mammalian user, wherein the mammalian user can be an infant or a pet, and each of the three or more instruments further comprising (a) one or more interior areas that are recessed with respect to a surface of the instrument or are located within a part of the instrument, and (b) one or more adhesive material components positioned in the one or more interior areas, the one or more adhesive material components comprising a reusable, non-toxic adhesive material and being configured to engage a counter-adhesive material on a surface of or contained within a support device; and (II) the support device, the support device (a) comprising the counter-adhesive material to the one or more adhesive material components of each of the three or more instruments and (b) being adapted to stably engage one or more stationary objects, such that when the support device stably engages the one or more stationary objects the support device remains in a fixed location, wherein the support device further (c) creates one or more surfaces when the support device engages the one or more stationary objects, wherein the one or more surfaces comprise either a single surface or two or more contiguous surfaces, and wherein the single surface or the two or more contiguous surfaces comprises the counter-adhesive material such that the single surface or the two or more contiguous surfaces can simultaneously bind the three or more instruments, wherein (III) the one or more adhesive material components of each of the three or more instruments and the counter-adhesive material of the support device are configured to (a) repeatedly bind to and release one another, such that when a respective instrument of the three or more instruments is bound to the support device the respective instrument is retained in a suspended position without spontaneous release even when the respective instrument is subjected to repeated daily use by the mammalian user, dishwashing, or both, for a period of at least about one week and (b) permit the adhesive material of the respective instrument and the counter-adhesive material to disengage from one another when the user applies a manual force causing the respective instrument to pull away from the support device, and further wherein each instrument of the three or more instruments that engages the support device is maintained in a stationary and fixed position on the support device and has the same general orientation with respect to the one or more stationary objects as any other instrument of the three or more instruments that engages the support device until the engaged instrument is removed from the support device.

8. The system of claim 7, wherein each instrument of the three or more instruments comprises a plurality of openings to the one or more interior areas thereby forming one or more exposed areas, wherein the one or more exposed areas are configured to receive the counter-adhesive material of the support device and permit the counter-adhesive material to adhere the adhesive material of the instrument, thereby adhering the instrument to the support device.

9. The system of claim 8, wherein the three or more instruments comprise at least one instrument that is a pacifier, the pacifier comprising (a) a guard component, (b) a core or handle component, and (c) a sucking component, wherein (d) the guard component, core or handle component, and the sucking component are non-detachable from each other, (e) the one or more exposed areas and the corresponding one or more adhesive material components of the pacifier are contained in the core or handle component, the guard component, or both the core or handle component and guard component, and (f) the pacifier attaches to and detaches from the support device in its entirety.

10. The system of claim 8, wherein (a) the pacifier lacks a ring-shaped handle component and (b) the one or more adhesive material components of the pacifier do not bind the handle component of the pacifier.

11. The system of claim 7, wherein the adhesive material of each instrument of the three or more instruments (a) is incorporated into a material of the instrument structure itself or (b) resides within a non-exposed interior portion of the instrument, wherein in either case, the adhesive material is adapted to exert, receive, or exert and receive, one or more forces applied through the material of the instrument such that the adhesive material is adapted to adhere to the counter-adhesive material through operation of the one or more forces without requiring that the adhesive material be directly bound by the counter-adhesive material.

12. The system of claim 7, wherein the support device is configured to bind to one or more bar components of a crib or a playpen in a releasable manner when acted on by an adult human user.

13. The system of claim 7, wherein the three or more instruments each comprise at least one indicator element, wherein the at least one indicator element of each of the three or more instruments provides adult human users with a discrete indication of when use of each of the three or more instruments should be discontinued.

14. The system of claim 7, wherein (a) at least part of the surface of the support device is made of a material that is different than the adhesive material of each of the three or more instruments and (b) the surface of the support device further comprises a plurality of spatially separated areas comprising the counter-adhesive material, wherein at least some spatially separated areas of the plurality of spatially separated areas vary in size with respect to one another.

15. The system of claim 7, wherein the three or more instruments comprise a teething ring.

16. The system of claim 7, wherein each one of the three or more instruments is a pet toy.

17. The system of claim 7, wherein each instrument comprises more than one discrete areas of the adhesive material which each can adhere to the counter-adhesive material.

18. The system of claim 7, wherein at least one of the contiguous surfaces is adapted to bind three or more of the instruments simultaneously.

19. The system of claim 7, wherein the support device is adapted to bind to more than one stationary object or two or more separate parts of the stationary object.

20. The system of claim 7, wherein most of the surface of the support device is composed of the counter-adhesive material.

21. The system of claim 7, wherein the system is adapted such that the mammalian user is able to repeatedly engage and disengage the adhesive material of the respective instrument and the counter-adhesive material without assistance from an adult human user.

22. The system of claim 7, wherein most of the support device is composed of a component that forms a single flat surface when bound to the one or more stationary objects.

* * * * *